US007901327B2

(12) United States Patent
Hargis

(10) Patent No.: US 7,901,327 B2
(45) Date of Patent: Mar. 8, 2011

(54) DEVICE AND METHOD FOR CERVICAL CURVATURE RESTORATION

(76) Inventor: Veronica Rose Hargis, Warwick, NY (US); Luther Calvin Hargis, legal representative, Warwick, NY (US)

( * ) Notice: Subject to any disclaimer, the term of this patent is extended or adjusted under 35 U.S.C. 154(b) by 367 days.

(21) Appl. No.: 12/099,619

(22) Filed: Apr. 8, 2008

(65) Prior Publication Data

US 2009/0254010 A1 Oct. 8, 2009

(51) Int. Cl.
*A63B 23/025* (2006.01)

(52) U.S. Cl. ..... 482/10; 482/124; 482/126; 482/907; 601/39

(58) Field of Classification Search ..... 482/10, 482/124, 126, 127, 140, 148, 907; 601/5, 601/39; 128/DIG. 23, 845; 54/19.1; 446/27–28
See application file for complete search history.

(56) References Cited

U.S. PATENT DOCUMENTS

| | | | | | |
|---|---|---|---|---|---|
| 16,300 | A | * | 12/1856 | Wilson | 297/393 |
| 72,467 | A | * | 12/1867 | Dunlap | 297/393 |
| 2,088,207 | A | * | 7/1937 | Kaiser | 297/392 |
| 2,284,058 | A | * | 5/1942 | Kaiser et al. | 297/392 |
| 2,791,999 | A | * | 5/1957 | Bustamante | 601/39 |
| 3,601,123 | A | * | 8/1971 | McFarland | 602/18 |
| 3,814,419 | A | * | 6/1974 | Bjorklund et al. | 482/124 |
| 4,219,193 | A | * | 8/1980 | Newman | 482/10 |
| 4,789,154 | A | | 12/1988 | Mattox | |
| 4,969,453 | A | * | 11/1990 | Heimann | 602/18 |
| 4,988,093 | A | | 1/1991 | Forrest, Sr. et al. | |
| 5,116,359 | A | | 5/1992 | Moore | |
| 5,162,027 | A | | 11/1992 | Robinson | |
| 5,176,622 | A | * | 1/1993 | Anderson et al. | 602/19 |
| 5,199,940 | A | | 4/1993 | Morris et al. | |
| 5,224,914 | A | * | 7/1993 | Friedman | 482/127 |
| 5,295,949 | A | | 3/1994 | Hathaway | |
| 5,498,218 | A | | 3/1996 | Proctor et al. | |
| 5,507,718 | A | * | 4/1996 | Kabat | 602/18 |
| 5,509,869 | A | | 4/1996 | Miller | |
| 5,569,176 | A | | 10/1996 | Graham | |
| 5,681,248 | A | * | 10/1997 | Vani | 482/126 |
| 5,713,841 | A | | 2/1998 | Graham | |
| 5,807,220 | A | * | 9/1998 | Allis et al. | 482/140 |
| 5,824,013 | A | | 10/1998 | Allen | |
| 5,989,167 | A | | 11/1999 | Manley et al. | |
| 6,080,090 | A | * | 6/2000 | Taylor et al. | 482/121 |
| 6,179,747 | B1 | | 1/2001 | Kelley | |
| D447,779 | S | | 9/2001 | Munger | |
| 6,409,694 | B1 | * | 6/2002 | Bugarin | 602/18 |
| 6,743,159 | B1 | * | 6/2004 | Taylor et al. | 482/127 |
| 6,788,968 | B2 | | 9/2004 | Pettibon | |

(Continued)

*Primary Examiner* — Rinaldi I Rada
*Assistant Examiner* — Andrew M Tecco
(74) *Attorney, Agent, or Firm* — Howson & Howson LLP

(57) ABSTRACT

A neck rehabilitation device for exercising the muscles of a person's neck and upper back is provided. The device has a rear neck-engaging assembly that can be positioned at least partially about the person's neck for engaging a rear side of the person's neck. The rear neck-engaging assembly includes an elastic strap for extending and being stretched about the rear side of the person's neck to exert a forward-directed force on the person's neck. The assembly also includes a resilient compressible member providing resistance to compression for use in exercising the muscles of the person's neck and upper back while the elastic strap is stretched about the person's neck. A method of cervical curve restoration of a person's neck is also provided. The method includes stretching a reversed cervical curve forward and simultaneously exercising the muscles of the person's neck and upper back.

8 Claims, 3 Drawing Sheets

U.S. PATENT DOCUMENTS 6,859,965 B1 * 3/2005 Gourd ..... 5/646
6,939,269 B2 9/2005 Makofsky
7,104,926 B2 9/2006 Carlson
7,150,719 B2 12/2006 Meyer
7,189,192 B2 3/2007 Edgeton
2006/0052219 A1 3/2006 Roberts et al.
2007/0021784 A1 1/2007 Hurd
2007/0027008 A1 * 2/2007 Levinson et al. ..... 482/121
2007/0191187 A1 8/2007 Reynolds

* cited by examiner

DEVICE AND METHOD FOR CERVICAL CURVATURE RESTORATION

BACKGROUND OF THE INVENTION

The present invention relates to patient cervical curvature restoration, and more particularly, the present invention relates to a neck exercising device or rehabilitation tool and a method of restoring and/or maintaining proper cervical spine curvature.

Cervical curve reversal is a physical condition that is accompanied by forward displacement of the head thereby requiring the muscles of the neck and upper back to contract progressively tighter as cervical kyphosis worsens. This condition is one of the leading causes of patient symptoms and degenerative spinal changes. The increased muscular force required to hold the displaced head increases spinal compression, which leads to advancing disk and joint deterioration. A host of patient symptoms are related, including neck pain, headaches, TMJ pain, radiculopathy, myofacial syndromes, upper back pain and fatigue, occipital neuralgia, balance problems or in-coordination, and emotional stress.

Various devices for exercising and/or supporting the neck are known. For example, see U.S. Pat. No.: 5,498,218 issued to Proctor et al.; U.S. Pat. No. 2,791,999 issued to Bustamante; U.S. Pat. No. 4,789,154 issued to Mattox; D.447,779 S issued to Munger; U.S. Pat. No. 5,295,949 issued to Hathaway; U.S. Pat. No. 5,681,248 issued to Vani; U.S. Pat. No. 5,989,167 issued to Manley et al.; U.S. Pat. No. 4,219,193 issued to Newman; U.S. Pat. No. 7,189,192 B2 issued to Edgeton; U.S. Pat. No. 4,988,093 issued to Forrest, Sr. et al.; U.S. Pat. No. 5,162,027 issued to Robinson; U.S. Pat. Nos. 5,713,841 and 5,569,176 issued to Graham; U.S. Pat. No. 5,824,013 issued to Allen; U.S. Pat. No. 6,788,968 B2 issued to Pettibon; U.S. Pat. No. 7,104,926 B2 issued to Carlson; U.S. Pat. No. 6,939,269 B2 issued to Makofsky; U.S. Pat. No. 6,179,747 B1 issued to Kelley; U.S. Pat. No. 5,509,869 issued to Miller; U.S. Pat. No. 5,116,359 issued to Moore; U.S. Pat. No. 5,199,940 issued to Morris et al.; and U.S. Pat. No. 7,150,719 B2 issued to Meyer. Also see U.S. Patent Application Publications Nos. 2006/0052219 A1 of Roberts et al., 2007/0191187 A1 of Reynolds, and 2007/0021784 of Hurd.

While the neck exercising devices and methods disclosed in the above referenced patents and published applications may function in a satisfactory manner for their intended purpose, there remains a need for an improved neck rehabilitation tool and exercise device for use in correcting lordosis, for restoring proper cervical spine curvature, and for strengthening the muscles of the neck and upper back. The device and method of restoration should enable a patient to achieve permanent and lasting curve correction. Preferably, the device should be affordable, available for daily use, and easy to use.

SUMMARY OF THE INVENTION

The present invention provides a neck rehabilitation device for exercising the muscles of a person's neck and upper back. The device has a rear neck-engaging assembly positionable at least partially about the person's neck for engaging a rear side of the person's neck. The rear neck-engaging assembly includes an elastic strap for extending and being stretched about the rear side of the person's neck to exert a forward-directed force on the person's neck. The assembly also includes a resilient compressible member providing resistance to compression during exercises involving the muscles of the person's neck and upper back while the elastic strap is stretched about the person's neck and applies a forward-directed force thereto.

According to another aspect of the present invention, a method of cervical curve restoration of a person's neck is provided. The method includes stretching a reversed cervical curve forward and simultaneously exercising the muscles of the person's neck and upper back. The simultaneous stretching and exercising steps are preferably performed with a portable, hand-held device having an elastic strap for applying a force to stretch the reversed cervical curve forward and a resilient compressible member providing resistance for exercising the muscles of the neck and upper back.

BRIEF DESCRIPTION OF THE DRAWINGS

The features and advantages of the present invention should become apparent from the following description when taken in conjunction with the accompanying drawings, in which.

DETAILED DESCRIPTION OF THE INVENTION

Figure 1:
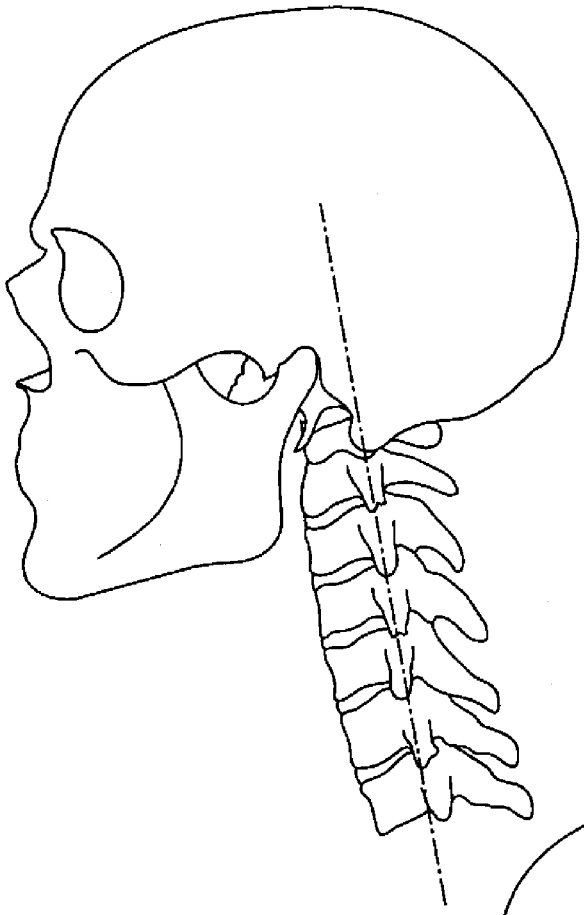
FIG. 1 is an example of a lateral cervical spine of a person having a cervical curve reversal condition.

The neck rehabilitation tool/exercising device 10 according to the present invention is used by a patient to restore cervical curvature. By way of example, and not by way of limitation, the lateral cervical spine of FIG. 1 shows a spine of a patient having a cervical curve reversal condition with negative or kyphotic 11° of spinal curve. A person with such a condition will likely be plagued with chronic neck and upper back pain and occasional headaches.

Figure 2:
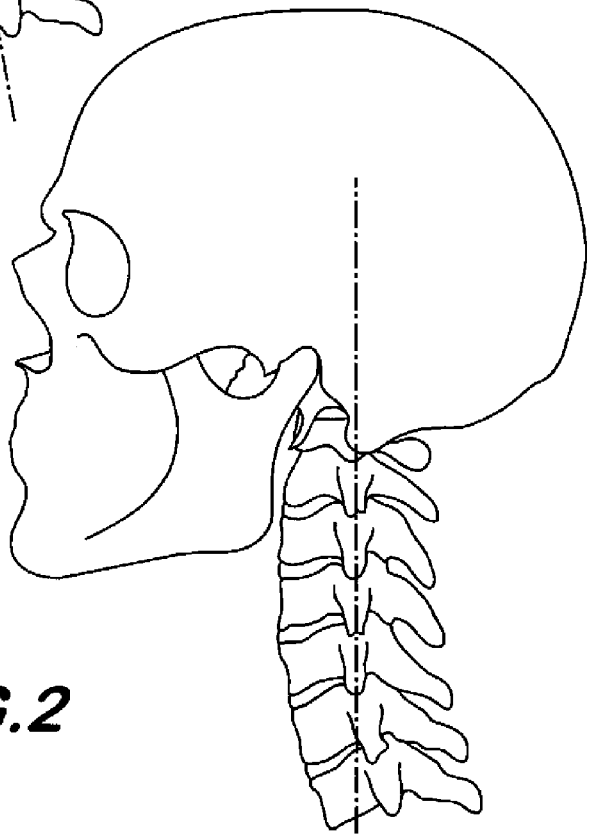
FIG. 2 is an example of a lateral cervical spine of a person with improved cervical curvature relative to that of FIG. 1.

In comparison, the lateral cervical spine x-ray of FIG. 2 shows a spine of a patient with a positive 4° of spinal curve which is a significant improvement from the condition illustrated in FIG. 1. Regular and repeated exercise performed with the device 10 of the present invention enables a patient to not only improve cervical curvature, but also restore proper, smooth, and perfect appearing lordotic cervical curve.

The device 10 of the present invention enables the patient to stretch the reversed cervical curve forward and then, with the cervical spine held in this proper curved position, to work the major muscles of the neck and upper back to strengthen the muscles so that the muscles ultimately hold the correction. It is not the vertebrae that are resistant to change of cervical curvature; rather, it is the soft tissue of the disks, joints, ligaments and muscles that must be worked to enable permanent and lasting curve correction.

Figure 3:
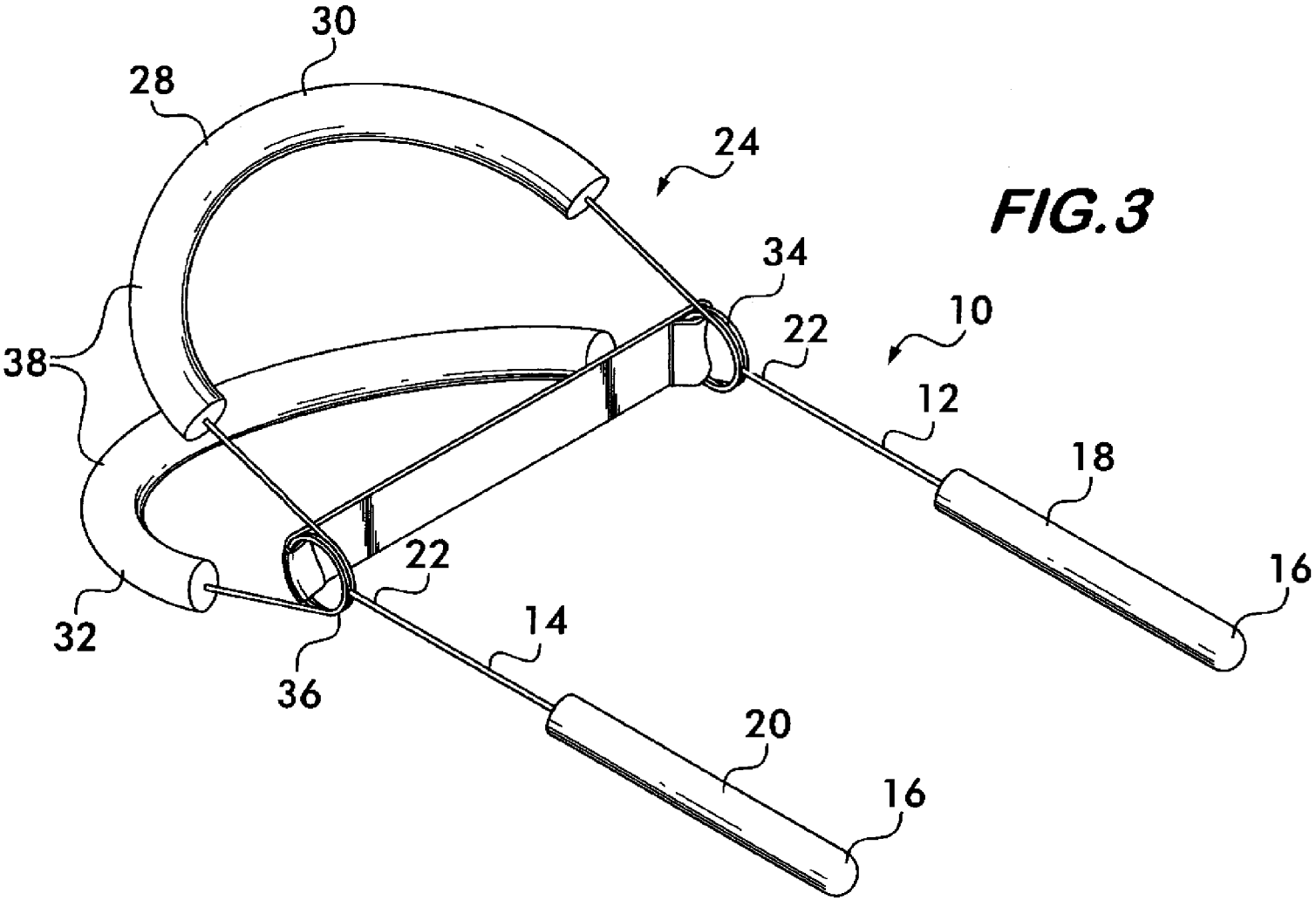
FIG. 3 is a perspective view of a rehabilitation tool or exercising device according to the present invention.

A contemplated embodiment of the device of the present invention is the portable, lightweight, manually-operated, hand-held device 10 illustrated in FIG. 3. This version of the present invention is easy to use thereby enabling daily in-home exercising, stretching, and strengthening of the neck that can be accomplished without assistance from other people or other more sophisticated equipment. As an example, about ten minutes of daily exercise with the device 10 should be sufficient to gradually restore proper cervical spine curvature over a period of about six to twelve months.

As best shown in FIG. 3, the device 10 includes a laterally spaced-apart pair of elongate handles, 12 and 14, that each has a proximal end 16 providing a hand grip, 18 and 20, and a distal end 22 interconnecting to a rear neck-engaging assembly 24. The handles, 12 and 14, illustrated in the drawings are substantially rigid; however, the handles can also be provided in the form of inelastic or elastic straps, webbing or the like, and a single handle can be used in place of the pair of handles.

In use, the rear neck-engaging assembly 24 extends behind and partially around the neck, head and/or shoulders of the patient while the proximal ends 16 of the handles, 12 and 14, extend in front of the patient for ready gripping by the patient. For example, see FIG. 4.

The rear neck-engaging assembly 24 includes a centrally-disposed, flexible, elastic strap or band 26 and a resilient compressible member 28 spaced behind the elastic strap 26. In the illustrated embodiment, the compressible member 28 is provided by a pair of bowed, substantially-inelastic, upper and lower supports, 30 and 32, interconnected by a pair of resilient, resistance coils, 34 and 36. Other types and arrangements of compressible members can also be utilized such as those made of resilient foam or some other compressible shape-memorizing material or arrangement of components, such as leafs springs, helical springs, rubber, or the like at any location along the length of the supports.

Figure 4:
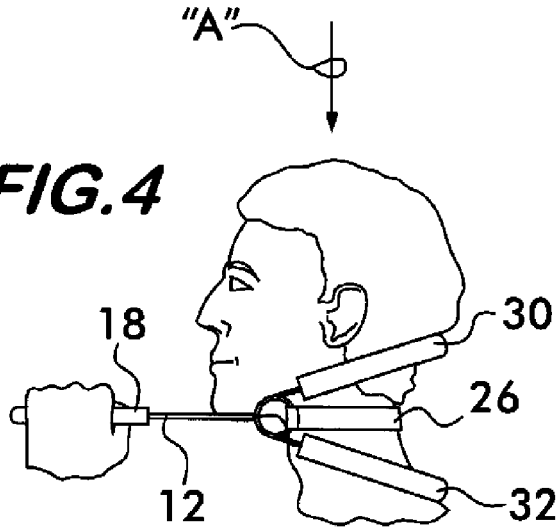
FIG. 4 is a side elevational view of the device of FIG. 3 positioned about the neck of a person in a starting position according to the present invention.

The elastic strap 26 extends between and in a transverse direction relative to the elongate handles, 12 and 14, adjacent the distal end 22 of the handles, 12 and 14. The elastic strap 26 is designed to be positioned across the back of the neck of the patient at about a mid-height of the neck while the pair of handles, 12 and 14, extends forwardly of the patient enabling ready and comfortable gripping by the patient's hands, for instance, as illustrated in FIG. 4.

The resistance coils, 34 and 36, of the illustrated embodiment are located adjacent the distal end 22 of the handles, 12 and 14, and adjacent opposite ends of the elastic strap 26. The coils, 34 and 36, provide a juncture connecting the opposite ends of the upper and lower supports, 30 and 32. Thus, the supports, 30 and 32, extend a spaced distance behind the elastic strap 26 and on an opposite side of the elastic strap 26 relative to the handles, 12 and 14. In the illustrated embodiment, the coils 34 and 26 connect directly to the handles, 12 and 14, and to the elastic strap 26; however, other means and arrangements for connecting the handles and straps to the device 10 can be utilized.

Preferably, the upper and lower supports, 30 and 32, provide generally curved, or arcuate, neck, head or shoulder engaging surfaces as each extends continuously from coil 34 to coil 36. The upper support 30 is adapted to engage and extend across a region of a patient's neck and/or head at about the base of the patient's skull. The lower support 32 is adapted to engage and extend across a region of the patient's neck and/or shoulders at about the base of the neck and/or top of the shoulders. See FIG. 4 for an example of this positioning of the supports, 30 and 32, relative to the patient's neck. The supports, 30 and 32, can include padding 38 along their lengths where the supports, 30 and 32, are expected to engage a patient's neck, head, or shoulders.

In use, the grips, 18 and 20, of the elongate handles, 12 and 14, are grasped by the patient, and the rear assembly 24 is positioned behind the neck of the patient. The elongate handles, 12 and 14, are disposed substantially horizontal with the proximal ends 16 extending forward of the patient. The patient pulls the handles, 12 and 14, in a forward direction with a light amount of force, typically about a few pounds of pressure (for instance, about four pounds of forward pressure). This amount of pressure is required to stretch the elastic strap 26 about the mid portion of the patient's neck. Ultimately, the upper and lower supports, 30 and 32, engage a rear side of the patient's neck, head and/or shoulders adjacent the top and base of the neck. In this position (see FIG. 4), further forward movement of the handles, 12 and 14, relative to the patient's neck is prevented and further expansion of the elastic strap 26 is prevented. Accordingly, the elastic strap 26 can be designed to readily apply only a desired amount of pressure to the rear of the patient's neck and this pressure cannot be exceeded due to the engagement of the supports, 30 and 32, with the patient's neck, head and/or shoulders.

When positioned in the above described fashion, the elastic strap 26 is designed, for instance, to apply about four pounds of forward pressure to the mid-cervical region of the neck. See FIG. 4. Thus, the cervical curve is stretched forward, even from a reverse cervical curve condition, and is held in this position as long as the patient applies forward pull on the handles, 12 and 14, of the device 10. This forward stretched position is maintained throughout the exercises described below.

In this position, the patient can use the device 10, more specifically the supports, 30 and 32, and the resistance coils, 34 and 36, to perform a series of neck rearward, lateral, or rotational neck extension and retraction exercises to strengthen the major muscles of the neck and upper back. The combination of simultaneous cervical spine forward stretching via the elastic strap 26 and neck exercises of the muscles in the neck and upper back against resistance of the coils, 34 and 36, enables gradual reshaping and strengthening of the patient's neck. Thus, through daily and/or routine periodic exercising, cervical curve restoration can be achieved within a few months and can be maintained.

Figure 5:
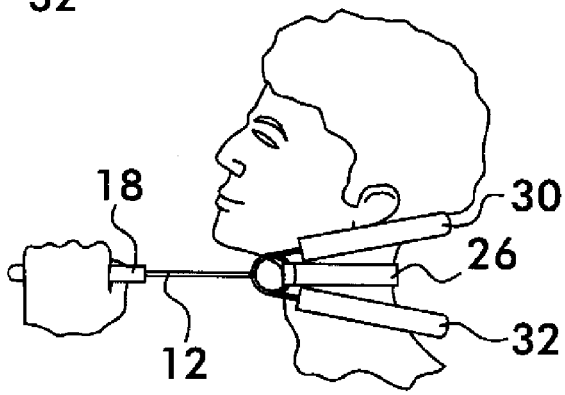
FIGS. 5-7 are side and front elevational views demonstrating neck exercises performed with the device of FIG. 3 according to the present invention.
Figure 6:
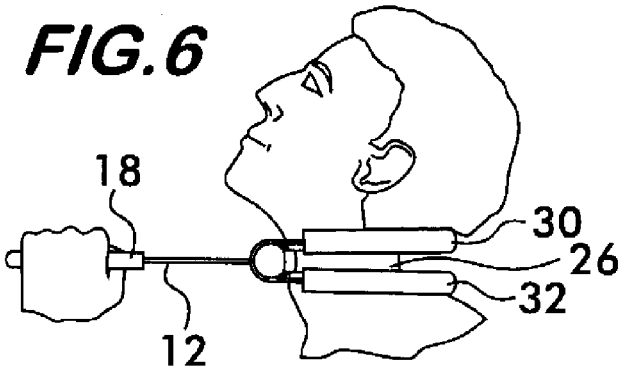
Figure 7:
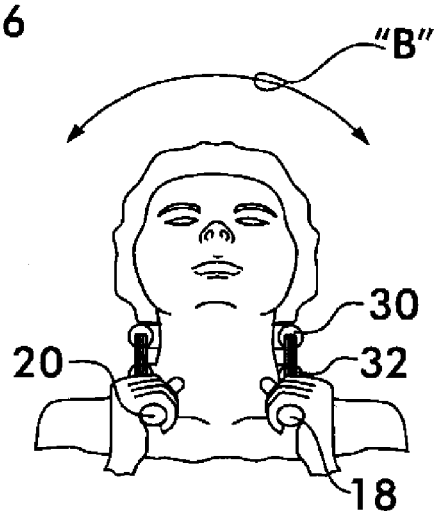

Some examples of exercises are shown in FIGS. 5-7. For instance, with the mid-cervical spine stretched in the forward position by the elastic strap 26 of the device 10 due to forward pull applied to the handles, 12 and 14, the patient can retract their neck like a turtle to move their head downwardly (see arrow "A" in FIG. 4) so as to at least partially compress the upper and lower supports, 30 and 32, against the resistance of the coils, 34 and 36. In addition, the patient can bend their neck backward (see FIGS. 6 and 7) or laterally toward one of their shoulders (see FIG. 5) to at least partially compress the upper and lower supports, 30 and 32, against the resistance of the coils, 34 and 36. The resistance coils 34 and 36 can be designed to provide a desired amount of resistance, for instance, about five to six pounds of resistance, during these exercises. The patient can hold the above stated retracted and/or neck bent positions for a predetermined time before returning the neck to a normal starting position (as shown in FIG. 4), or the patient can slowly rotate their head for about 180° from shoulder-to-shoulder during these exercises (for instance, see arrow "B" in FIG. 7). All of the above can be repeated a number of times for a number of sets.

The method of restoring cervical curvature includes using device 10 to perform some or all of the above discussed neck exercises periodically over a period of time, such as daily exercises for about ten minutes a day performed over a course of several months. The muscles of the neck and upper back are gradually strengthened during the exercises that are performed while forward pressure is applied on the back of the cervical spine to properly position the cervical spine during the exercises. As the muscles gradually strengthen, they are ultimately able to maintain proper cervical curvature. Exercises can be continued to permanently maintain proper curvature.

Various changes can be made to the structure of the device 10 and the method of using the device. For an example, any means for providing resistance during the neck extension, retraction, and/or rotation exercises can be used in place of the coil springs and pair of supports illustrated in the drawings. Further, the upper and lower supports can be replaced with a single shape-memory material that can be compressed and resiliently expanded, such as foam or other materials. Further, one or more strap-type handles can be used in place of the pair of elongate rigid handles. Still further, the amount of force and/or resistance provided by the elastic strap and resilient compressible member can be adjusted and/or designed as desired.

While preferred rehabilitation and exercise devices, exercises, and methods of restoring and maintaining proper cervical curvature have been described in detail, various modifications, alterations, and changes may be made without departing from the spirit and scope of the device and method according to the present invention as defined in the appended claims.

The invention claimed is:

1. A neck rehabilitation device for exercising the muscles of a person's neck and upper back, comprising:

a rear neck-engaging assembly positionable at least partially about the person's neck for engaging a rear side of the person's neck, said assembly including an elastic strap for extending and being stretched about the rear side of the person's neck to exert a forward-directed force on the person's neck and a resilient compressible member providing resistance to compression for use in exercising the muscles of the person's neck and upper back while said elastic strap is stretched about the person's neck, said resilient compressible member including spaced-apart, non-contacting, rigid upper and lower supports each having opposite ends and being interconnected only at said opposite ends by a pair of resistance coils enabling said supports to be compressed toward one another during neck exercises and resiliently expanded away from one another, said upper support being engagable with an upper portion of the person's neck at a base of the skull when said lower support is engaged with a base of the person's neck adjacent the person's shoulders, said elastic strap having opposite ends connected to said resistance coils such that said elastic strap extends directly between said resistance coils, said resistance coils providing the only juncture between said upper and lower supports and said elastic strap, and the neck rehabilitation device further comprising a pair of handles with one of said handles extending from one of said resistance coils and the other of said handles extending from the other of said resistance coils.

2. The device according to claim 1, wherein said resilient compressible member extends a predetermined distance behind said elastic strap such that engagement of said resilient compressible member with the person's neck prevents further stretching of said elastic strap.

3. The device according to claim 2, wherein said pair of handles extends forward of said rear neck-engaging assembly for use by the person in applying a forward directed force to simultaneously locate said resilient compressible member against the person's neck and stretch said elastic strap about the person's neck.

4. The device according to claim 3, wherein the device is a manual, portable, hand-held device.

5. The device according to claim 4, wherein, when said resilient compressible member is positioned against the person's neck, said stretched elastic strap applies a force to stretch the person's cervical curve forward.

6. The device according to claim 4, wherein said elastic strap applies a force of about four pounds to the person's neck when said resilient compressible member is positioned against the person's neck.

7. The device according to claim 6, wherein said resilient compressible member provides about five to six pounds of resistance during neck retraction, rearward extension, lateral extension, and extension with rotation exercises.

8. A neck rehabilitation device for exercising the muscles of a person's neck and upper back, comprising:

a pair of separate, spaced-apart, non-contacting supports including a substantially-inelastic bowed upper support having opposite ends and a substantially-inelastic bowed lower support having opposite ends, said supports for engaging about a rear portion of the person's neck, head or shoulders adjacent a top and base of the neck;

a pair of resistance coils located at said opposite ends of said upper and lower supports interconnecting said upper and lower supports at said opposite ends and providing junctures therebetween such that said supports are compressible toward one another during neck exercises and are resiliently expandable away from one another by said resistance coils;

an elastic strap extending a spaced distance in front of said pair of supports such that said elastic strap does not contact said supports and is for extending and being stretched about the rear side of the person's neck to exert a forward-directed force on the person's neck, said elastic strap having opposite ends connected to said resistance coils such that said elastic strap extends directly between said resistance coils; and a pair of spaced-apart rigid elongate handles each having a proximal end with a hand grip and a distal end extending from a respective one of said resistance coils, said handles extending forward of said elastic strap.

* * * * *